US007963075B2

(12) United States Patent
Howland

(10) Patent No.: US 7,963,075 B2
(45) Date of Patent: Jun. 21, 2011

(54) INFLATABLE BARRIER

(75) Inventor: Charles A Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 849 days.

(21) Appl. No.: 11/561,453

(22) Filed: Nov. 20, 2006

(65) Prior Publication Data

US 2007/0113486 A1 May 24, 2007

Related U.S. Application Data

(60) Provisional application No. 60/738,887, filed on Nov. 22, 2005.

(51) Int. Cl.
*E06B 3/26* (2006.01)
*E04B 1/34* (2006.01)

(52) U.S. Cl. ..... 52/202; 52/2.11; 52/2.14; 52/2.15; 52/2.19; 52/2.23; 52/DIG. 12; 160/40

(58) Field of Classification Search ..... 52/2.11, 52/2.13–2.15, 2.18–2.25, 202, DIG. 12; 89/36.01–36.17; 160/40, 44
See application file for complete search history.

(56) References Cited

U.S. PATENT DOCUMENTS

| | | | | | |
|---|---|---|---|---|---|
| 2,028,060 | A | * | 1/1936 | Gilbert | 47/32.5 |
| 2,672,628 | A | * | 3/1954 | Spanel | 5/655 |
| 2,748,391 | A | * | 6/1956 | Lewis, Jr. et al. | 2/2.5 |
| 2,758,952 | A | * | 8/1956 | Toulmin, Jr. | 428/630 |
| 2,854,014 | A | * | 9/1958 | Hasselquist | 52/2.19 |
| 2,946,337 | A | * | 7/1960 | Wolshin | 52/2.21 |
| 3,138,506 | A | * | 6/1964 | Ross | 156/147 |
| 3,205,106 | A | * | 9/1965 | Cross | 156/79 |
| 3,303,615 | A | * | 2/1967 | O'Neal | 52/2.13 |
| 3,388,509 | A | * | 6/1968 | Mora | 52/2.15 |
| 3,457,684 | A | * | 7/1969 | Wood, Jr. | 52/2.21 |
| 3,517,707 | A | * | 6/1970 | Hayes et al. | 139/410 |
| 3,538,957 | A | * | 11/1970 | Rheaume | 139/384 R |
| 3,675,377 | A | * | 7/1972 | Suter | 52/2.16 |
| 3,745,938 | A | * | 7/1973 | Hathaway et al. | 109/49.5 |
| 4,023,372 | A | * | 5/1977 | Didow et al. | 61/45 R |
| 4,040,210 | A | * | 8/1977 | Land | 52/2.12 |
| 4,044,510 | A | * | 8/1977 | O'Neal | 52/2.13 |
| 4,076,872 | A | * | 2/1978 | Lewicki et al. | 428/12 |
| 4,098,035 | A | * | 7/1978 | Bessler | 52/2.12 |

(Continued)

FOREIGN PATENT DOCUMENTS

EP 21892 A1 * 1/1981

(Continued)

*Primary Examiner* — Robert J Canfield
*Assistant Examiner* — Charissa Ahmad
(74) *Attorney, Agent, or Firm* — Vern Maine & Associates

(57) ABSTRACT

An inflatable barrier system for a doorway or other opening comprising a front side envelope of rectangular front elevation and dog bone shaped horizontal plane cross section, inflatable with gas and fillable with a hardening foam, combined with an inflatable back side array of tubular air beams configured with self sealant, both connected to a source of gas for inflating the fabric envelope and the back side array of tubular air beams. The front side envelope is configured for frontal resistance to predetermined levels of push, cut, puncture, flame, chemical, and ballistic attack. The system is used as a method for closing a doorway to such attacks by erecting and inflating the system within the opening such that the edges on either side of the opening are gripped between the lobes of the respective ends of the dog bone profile of the front side envelope.

18 Claims, 8 Drawing Sheets

U.S. PATENT DOCUMENTS 4,103,369 A * 8/1978 Riordan ..... 52/2.14
4,114,325 A * 9/1978 Hochstein ..... 52/2.21
4,251,959 A * 2/1981 Hsu ..... 52/2.21
4,255,907 A * 3/1981 Lightell ..... 52/2.12
4,340,626 A * 7/1982 Rudy ..... 428/35.7
4,629,433 A * 12/1986 Magid ..... 441/40
4,750,299 A * 6/1988 Frommelt et al. ..... 52/2.13
4,782,735 A * 11/1988 Mui et al. ..... 89/36.07
4,821,468 A * 4/1989 Moore ..... 52/2.13
4,833,813 A * 5/1989 McLemore, Jr. ..... 43/1
4,899,962 A * 2/1990 Mueller ..... 244/129.2
4,916,870 A * 4/1990 Moore ..... 52/2.13
4,964,249 A * 10/1990 Payne ..... 52/70
5,077,945 A * 1/1992 Koeniger ..... 52/169.14
5,317,118 A * 5/1994 Brandberg et al. ..... 219/727
5,565,264 A 10/1996 Howland
5,586,594 A * 12/1996 Shapoff ..... 160/135
5,649,466 A * 7/1997 Genovese ..... 89/1.11
5,813,172 A * 9/1998 McNally ..... 52/2.25
5,837,623 A 11/1998 Howland
5,937,595 A * 8/1999 Miller ..... 52/202
5,976,996 A 11/1999 Howland
6,029,405 A * 2/2000 Wood ..... 52/2.23
6,029,558 A * 2/2000 Stevens et al. ..... 89/36.17
6,052,829 A 4/2000 Kindler
6,108,980 A * 8/2000 Braun ..... 52/2.16
6,128,862 A * 10/2000 Katz ..... 52/2.11
6,266,818 B1 7/2001 Howland et al.
6,266,926 B1 * 7/2001 Figge et al. ..... 52/1
6,279,449 B1 * 8/2001 Ladika et al. ..... 89/36.17
6,298,607 B1 * 10/2001 Mostaghel et al. ..... 52/1
6,355,700 B1 * 3/2002 Uekado et al. ..... 521/107
6,373,384 B1 * 4/2002 Ferguson et al. ..... 340/540
6,412,391 B1 * 7/2002 Stevens et al. ..... 89/36.17
6,453,840 B1 * 9/2002 Higginbotham et al. ..... 114/345
6,460,192 B2 10/2002 Kindler
6,470,784 B1 * 10/2002 Bonavita et al. ..... 89/36.17
6,537,654 B1 * 3/2003 Gruber et al. ..... 428/293.4
6,543,055 B2 4/2003 Howland et al.
6,548,430 B1 4/2003 Howland
6,668,868 B2 12/2003 Howland et al.
6,693,052 B2 2/2004 Howland
6,718,706 B2 * 4/2004 Katz ..... 52/211
6,834,685 B2 12/2004 Hannigan et al.
6,895,851 B1 * 5/2005 Adams et al. ..... 89/36.02
6,911,247 B2 6/2005 Howland
6,998,165 B2 2/2006 Howland
7,007,308 B1 3/2006 Howland et al.
7,094,144 B2 * 8/2006 Dube ..... 454/334
7,178,445 B2 * 2/2007 Wulvik et al. ..... 89/36.02
7,192,498 B2 3/2007 Howland
7,213,497 B1 * 5/2007 Garcia et al. ..... 89/36.02
7,284,470 B2 * 10/2007 Huber et al. ..... 89/36.02
7,341,113 B2 * 3/2008 Fallis et al. ..... 169/46
7,464,506 B2 * 12/2008 Atkinson ..... 52/202
7,562,493 B2 * 7/2009 Kassianoff ..... 52/2.25
7,748,169 B2 * 7/2010 Cote ..... 52/2.11
2002/0152881 A1 * 10/2002 Stevens et al. ..... 89/36.17
2003/0129138 A1 * 7/2003 Loghman-Adham ..... 424/45
2004/0074150 A1 * 4/2004 Wycech ..... 52/2.13
2004/0253919 A1 * 12/2004 Dube ..... 454/274
2005/0118716 A1 6/2005 Howland et al.
2005/0197024 A1 9/2005 Howland
2005/0288797 A1 12/2005 Howland
2006/0027088 A1 * 2/2006 Wulvik et al. ..... 89/36.02
2006/0029759 A1 2/2006 Hannigan et al.
2006/0068158 A1 3/2006 Howland
2006/0070305 A1 * 4/2006 Atkinson ..... 52/36.1
2007/0077123 A1 * 4/2007 Williams et al. ..... 405/107
2007/0151441 A1 * 7/2007 Reinikainen et al. ..... 89/36.07
2007/0181271 A1 * 8/2007 Earnest ..... 160/368.1
2007/0234894 A1 * 10/2007 Lucuta et al. ..... 89/36.02
2008/0216416 A1 * 9/2008 Leano ..... 52/2.22
2008/0313969 A1 * 12/2008 Colucci et al. ..... 52/2.18
2009/0197518 A1 * 8/2009 Reuther et al. ..... 454/170
2009/0266226 A1 * 10/2009 Beach et al. ..... 89/36.02

FOREIGN PATENT DOCUMENTS

EP 270367 A * 6/1988
FR 2639673 A * 6/1990
GB 2169396 A * 7/1986
GB 2216935 A * 10/1989
GB 2301086 A * 11/1996
JP 53010695 A * 1/1978
JP 02292468 A * 12/1990
JP 05033530 A * 2/1993
JP 09217003 A * 8/1997
WO WO 9411613 A1 * 5/1994
WO WO 9413909 A2 * 6/1994

* cited by examiner

INFLATABLE BARRIER

RELATED APPLICATIONS

This application claims the benefit of U.S. Provisional Application No. 60/738,887, filed Nov. 22, 2005, herein incorporated in its entirety by reference.

FIELD OF THE INVENTION

The invention relates to an inflatable barrier system for closing an opening against external penetrators, and in particular to an inflatable barrier system and method for closing off an open doorway to external attack by push, cut, puncture, flame, chemical and ballistic means.

BACKGROUND OF THE INVENTION

There exists a need for a man-portable barrier system suitable for closing off an open doorway or similar opening that is resistant, when deployed, to external attacks by a variety of means including pushing, cutting, puncture, flame, chemical, and ballistic means, so as to provide an increased measure of protection to users taking refuge behind it. The barrier system should be small and light weight for manual transporting when necessary, be self-contained as to the tools needed for its use, be adaptable in its use to fit a normal range of doorway opening sizes, and be quickly deployable when the threat of attack is imminent. It should resist such attacks, when deployed, up to its design limit, for a predictable minimum period of time.

What is needed, therefore, are materials, systems and techniques combined in a manner to meet these objectives.

SUMMARY OF INVENTION

There is herein described an inflatable barrier system for closing a doorway or similar opening against various types of frontal assault. The term "doorway" for the purpose of this disclosure is intended to include doorways, window openings and any opening generally susceptible of edge definition by an existing or supplemental reinforcing edge member, the closing of which will contribute to the closing off or securing of a defined area or space for protection against a variety of external or frontal attacks. The inflatable barrier system of the invention includes multiple embodiments of an inflatable barrier structure and related methodologies whereby the barrier is positioned and inflated to close the opening and protect it against a variety of external threats. The system may include supplemental reinforcing edge members to further define and strengthen the edges of the opening.

In one aspect, the inflatable barrier comprises a front side fabric envelope of rectangular front elevation and dog bone shaped, horizontal plane cross section. It is inflatable with gas and fillable with a hardening foam. It may be combined with an inflatable back side array of tubular air beams configured with self sealant. Each inflatable component or gas envelope is connected to a source of gas for forming the barrier. The front envelope component may be configured for frontal resistance to predetermined levels of push, cut, puncture, flame, chemical, and ballistic attack. The system may be employed as a method for closing a doorway to predetermined levels of any or all of push, cut, puncture, flame, chemical, and ballistic attack. The method may comprise erecting and inflating the system within a doorway such that the door jam on either side of the doorway is gripped between the lobes of the respective ends of the dog bone profile of the fabric envelope. Reinforcing edge members, which may be telescoping carbon epoxy tubular structures, may be included in the system for application to the door jambs or edges of the opening to define and strengthen the edge for holding the inflatable barrier in place.

To complete the attachment of the inflatable barrier to the doorframe, the structural air bladders of the device are inflated with gas and with FR (fire rated) polyurethane foam. After the cure time is complete, the fire rated polyurethane foam provides added compression resistance. The backside array of inflated elements may use a pre-compressed, molded-foam, self-sealing neoprene and makeup reserve gas supply to retain pressure after ballistic and puncture attacks.

The front envelope may utilize any or all of carbon/glass/silicon and Vectran/polyurethane systems to address heat-flame and fabric cut and tear issues. It may use ceramic loaded coatings to thwart edge weapons attacks and CS powder (Orthochlorobenzylidenemalononitrile) filled bladders to discourage the aggression of the mechanical attack on the system. The back side array of self-sealing bladders and gas supply system are intended to be redundant to reduce the system damage from ballistic attack.

The applicant's inflatable barrier system, such as would serve as an Indoor Site Access Denial (ISAD) barrier, may be based on high-strength, drop-thread woven fabric, inflatable components, in combination with cut and puncture resistant methods and fabrics adopted from its body armor and other protective fabric systems. Readers are referred to the inventor's previously published patents and applications relating to protective fabrics, fabric seams and related structures methods, which are incorporated for all purposes by this reference.

The system in most but not all embodiments is intended to be portable for field use or distributed and stored at selected sites where it would be employed mainly as a defensive tool or shield to protect persons taking refuge there within. It is strictly intended for one time use, although select components might be salvageable for reuse in replacement systems. The inflatable barrier system is by design as light as practical. The kit of all necessary components is carefully compacted and prepackaged as a self contained system of the lowest practical volume and quickest practical deployment, prior to distribution to end users.

DETAILED DESCRIPTION

The invention is susceptible of many embodiments. What is illustrated and described is one embodiment and should not be interpreted as limiting of the invention.

Drop thread weaves are two layer wovens with interconnecting threads or yarns that control shape of the final inflated structure by the use of the controlled length and placement of the interconnecting yarns. The connecting yarns are woven on plush or velvet type weaving machines with a 3 or 3 warp configuration. Desired horizontal cross-sectional shapes such as the dog-bone shape of FIG. 1A and FIG. 1B can be created by varying the length of the connecting drop threads along the weave. Note that the term "dog bone shape," is used throughout to describe the general shape which is illustrated in FIG. 1A and FIG. 1B, the shape having an elongated central region 19 which extends in a horizontal barrier direction, the central region 19 being terminated at each end by a pair of opposing lobes 27A-D, each pair of opposing lobes 27A-D defining a vertically oriented edge gripping channel 30 which extends parallel to the horizontal barrier direction and is bounded on opposing sides by the opposing lobes 27A-D, the opposing lobes 27A-D being thereby able to extend along opposing sides of a door frame, or wall end placed within the channel 30, and to press toward each other in a directly opposing relationship when inflated, so as to grip the edge of the door frame, wall end, or other substantially flat structure between them.

Figure 1A:
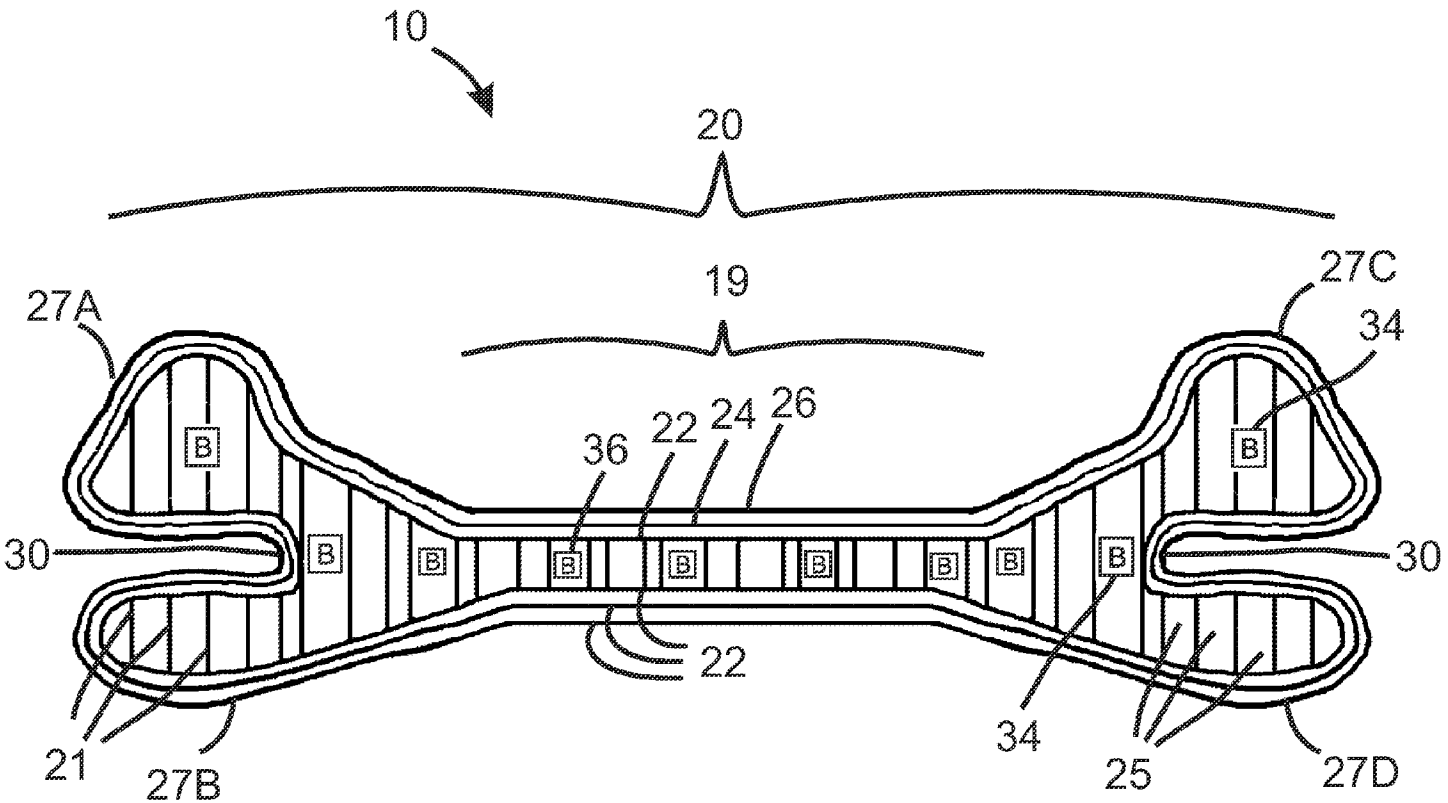
FIG. 1A is a diagrammatic view of a horizontal planar section of a front side envelope of one embodiment of the invention, shown fully inflated and formed.

Referring to the figures, FIG. 1A is a diagrammatic view of a horizontal planar section of the inflatable components of one embodiment of the invention, an inflatable barrier system 10, shown fully inflated and formed as it would be deployed in a doorway. It comprises a front side fabric envelope 20 of rectangular front elevation and dog bone shaped, horizontal plane cross section as formed by connections 21 which in the embodiment of FIG. 1A are walls connecting opposing sides of the fabric envelope 20 and forming thereby a plurality of bladders 25 which are inflatable with gas and fillable with a hardening foam. Additional bladders 34 are included so as to enhance gripping of a surrounding opening, and CS bladders 36 are included which can be filled with CS powder.

The fabric envelope 20, and in particular the face 22 of the envelope, may be insulated and armored or otherwise configured for frontal resistance to predetermined levels of push, cut, puncture, flame, chemical and ballistic attack. Envelope 20 with its edge gripping channels 30 may be formed by other means, such as drop thread weaving, or in addition to drop thread weaving, such as by assembling some or all flexible envelope components with bonding adhesives and/or mechanical fasteners. Known techniques for assembling fabric structures include those illustrated and explained in the inventor's other published patents and applications on fabric technologies, which are incorporated herein by this reference. The embodiment of FIG. 1A also includes an integral abrasive cord that can be accessed and used from the back side of the deployed barrier to cut off a lobe 27B of the dog bone and thereby release the barrier from the surrounding opening. FIG. 1B is a horizontal planar section of an embodiment similar to FIG. 1A which is shaped by connections 21 due to drop-thread weaving, and which includes an inflatable back side array 40 of tubular gas beams.

Figure 1B:
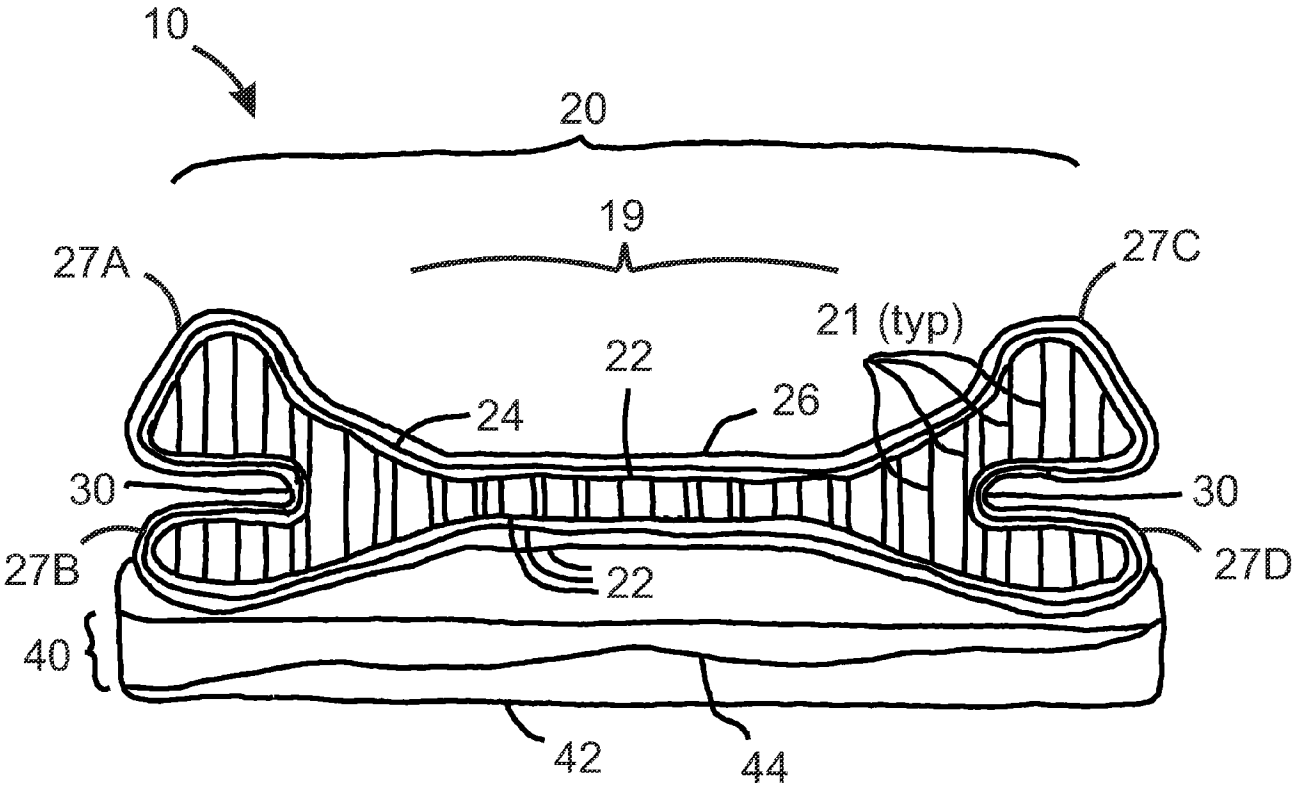
FIG. 1B is a diagrammatic view of a horizontal planar section of a front side envelope and inflatable back side array of tubular gas beams of another embodiment of the invention, shown fully inflated and formed.
Figure 2:
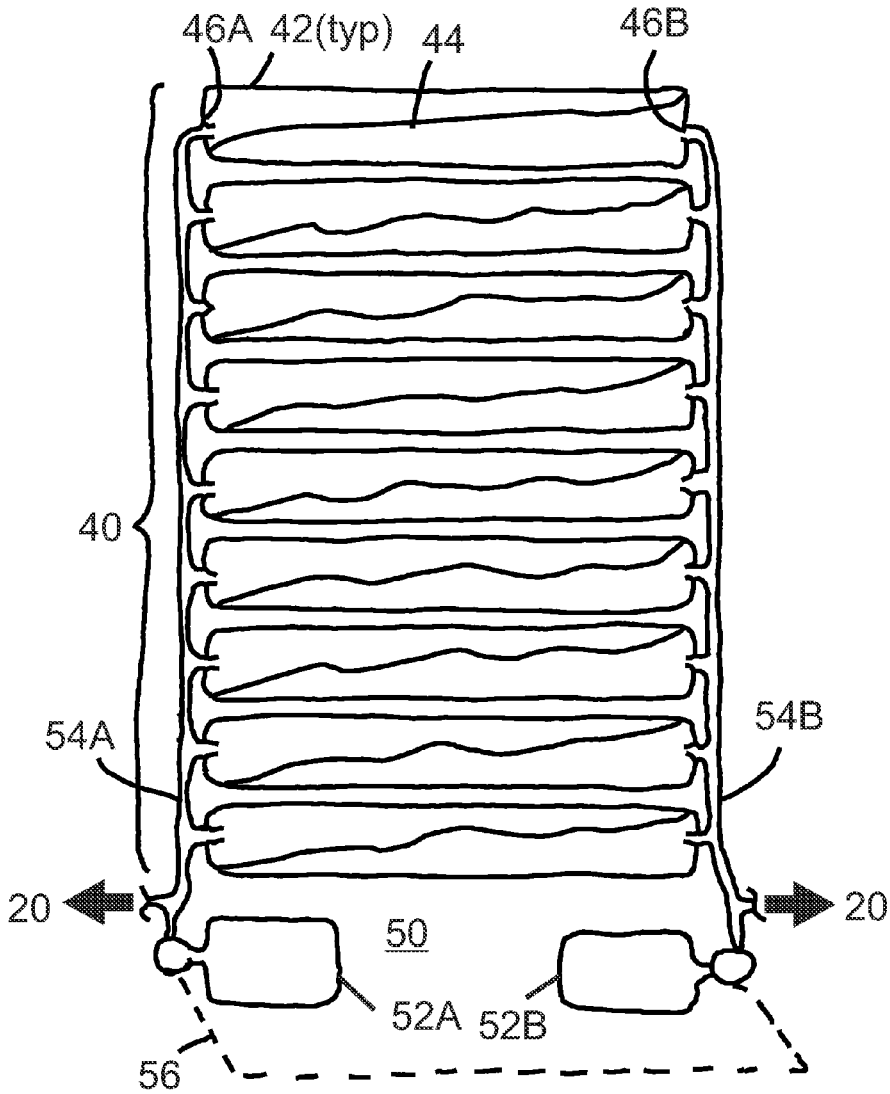
FIG. 2 is a diagrammatic rear elevation of the embodiment of FIG. 1B, showing redundant gas sources and gas lines feeding a multiple gas envelope array of the device from both ends.

Referring to FIG. 2, there is shown a diagrammatic rear elevation of the embodiment of FIG. 1B, and an inflation system 50 with redundant gas sources 52A and 52B, configured with respective inflation manifolds 54A and 54B feeding opposite sides of stacked array 40. The redundant gas sources are triggered for inflation by a common control system 56. Array 40 is comprised of horizontally disposed gas beams 42, stacked in a vertical array and connected on each end to the inflation system through respective check valves 46A and 46B in each gas beam 42.

Front side envelope 20 in this embodiment is also filled by gas source 50 through manifolds 54A and 54B. Envelope 20 is in this manner combined with inflatable back side array 40 of tubular air beams 42 and all are configured with self sealant for quickly sealing such leaks as may occur during frontal assaults on the deployed barrier.

In other embodiments, envelope 20 may have an independent source of inflation. Any or all of the gas envelopes of the system may be configured with internal sources of compressed gas for initial inflation. An independent gas source for envelope 50 may include an expanding FR foam component in addition to inflation gas, which will result in the inflated envelope hardening after an appropriate cure time as an armored, insulated, rigid shield or barrier. Also, the inflation system 50 illustrated in FIG. 2 may in some embodiments have a limited purpose of maintaining full inflation pressure in the gas envelopes of array 40 after another source or sources have provided the initial inflation. This is useful in the event of penetration and leakage of any of the gas beams or envelopes of array 40, until self-sealing of the leak has occurred.

Gas beams 42 may be configured with a flexible partition 44 of excess material running end to end within the beam, dividing the gas beam envelope functionally into two independent beams, and insuring that the volumetric void created by a failure relating to one independent portion of the beam and/or its respective fill port 46A, will be filled by the immediate expansion of the remaining portion of the beam and its respective fill port 46B, (or vice versa). Also note that the partition 44 of FIG. 2 for ease of illustration is shown as having a substantially horizontal plane. However, other embodiments, as shown in FIG. 1B, may configure partition 44 with a vertical orientation so that it contributes an additional layer of puncture resistance to the overall system with respect to frontal assaults on the system, whether or not there is a partial beam pressure failure.

Another embodiment of array 40 may be constructed with adjacent gas beams 42 having sufficient circumferential wall length and potential cross section area and volumetric capacity such that the space vacated by the failure of one gas beam 42 can be filled by the vertical expansion of one or both adjacent gas beams 42, thereby maintaining the integrity of the array as a component of the system.

Referring again to FIG. 1B, in one embodiment, elements of the inflatable barrier envelope 20 of the invention include woven core layers 22 of larger denier Vectran fiber at less than 0.5 lb/ft, having a breaking strength greater than 400 lbs per yarn group. These layers are of drop thread woven configuration, specifically configured to cause the drop threads 21 to create the dog-bone shaped profile of FIG. 1B.

There may be additional protective layers 24 of glass insulation, such as a glass mat and a base metalized layer for IR reflectance. This is a well understood system for high heat and direct flame exposure. The silicon will not burn and is a poor conductor. There may be a further protective outer layer 26 of carbon/glass fiber. Carbon, fiber glass silicon/silicon carbide outer layer 26 provides an anti-cut and heat resistant layer. The carbon glass/glass mat protects the rest of the system from heat and direct flame.

The use of Vectran fiber permits very high strength and very high burst pressures in the drop thread assembly of envelope 20. This allows inflation to a pressure sufficient to generate very high clamping forces on the door opening edges and edge members, and high compressive stiffness against frontal assaults.

The dog-bone drop-thread void of envelope 20 in one embodiment is filled during inflation with halogenated fire resistant urethane foam infill of less than 0.2 lb/ft3. Internal pressure bladders of envelope 20 or gas beams 42 may contain or be filled with CS powder. In the event that one or more of the pressure bladders are penetrated the gas released will carry a blast of CS powder toward the attacker. This discourages a more aggressive behavior on the part of the attacking individual. The self-sealing redundant high pressure beams 42 of "tube weave" Vectran provide for mounting and rigidity. The air beams 42 of array 40 use a system of a two-fabric layers sandwich with a foamed neoprene inner layer. This system was developed for HUMVEE tire runflat capability and is a simple and reliable self-seal method.

Other flexible armor systems and protective materials and techniques such as those disclosed by this inventor in his other patents and published applications may be incorporated in the flexible components of system 10 to further enhance the protective attributes of the device.

Figure 3A:
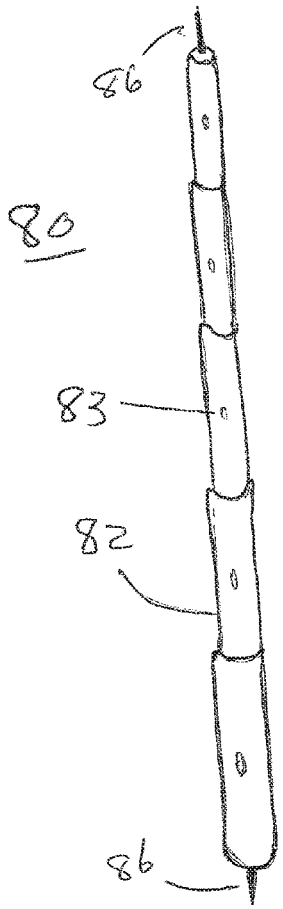
FIG. 3A is a perspective view of an example of a telescoping edge reinforcing member intended for strengthening and defining the opening in which the inflatable components of the invention may be deployed, the edge members being made of cylindrical pultruded carbon segments.
Figure 3B:
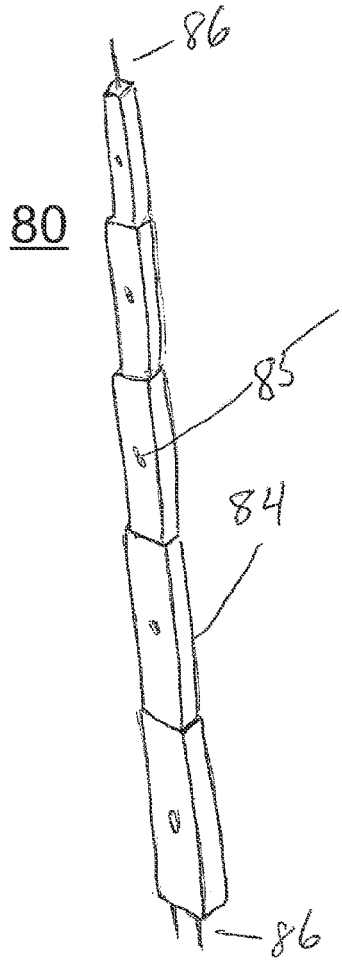
FIG. 3B is a perspective view of an example of a telescoping edge reinforcing member intended for strengthening and defining the opening in which the inflatable components of the invention may be deployed, the edge members being made of rectangular segments.
Figure 3C:
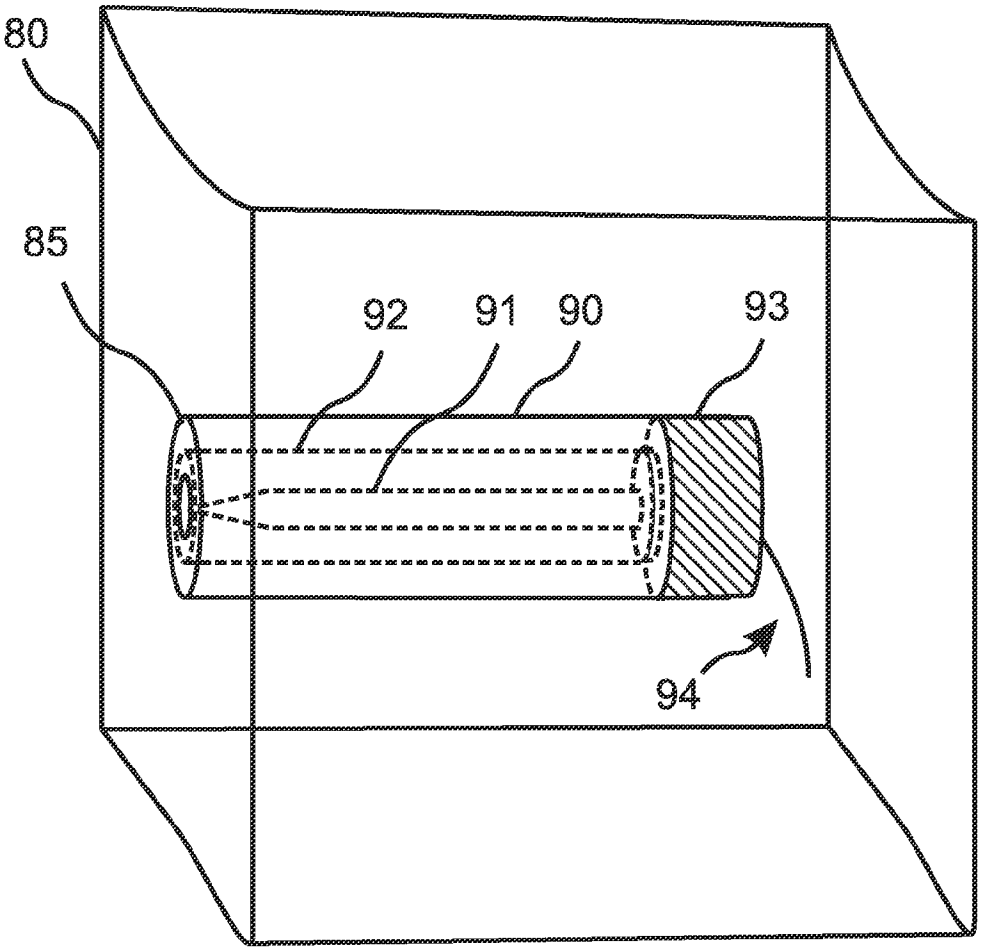
Figure 3D:
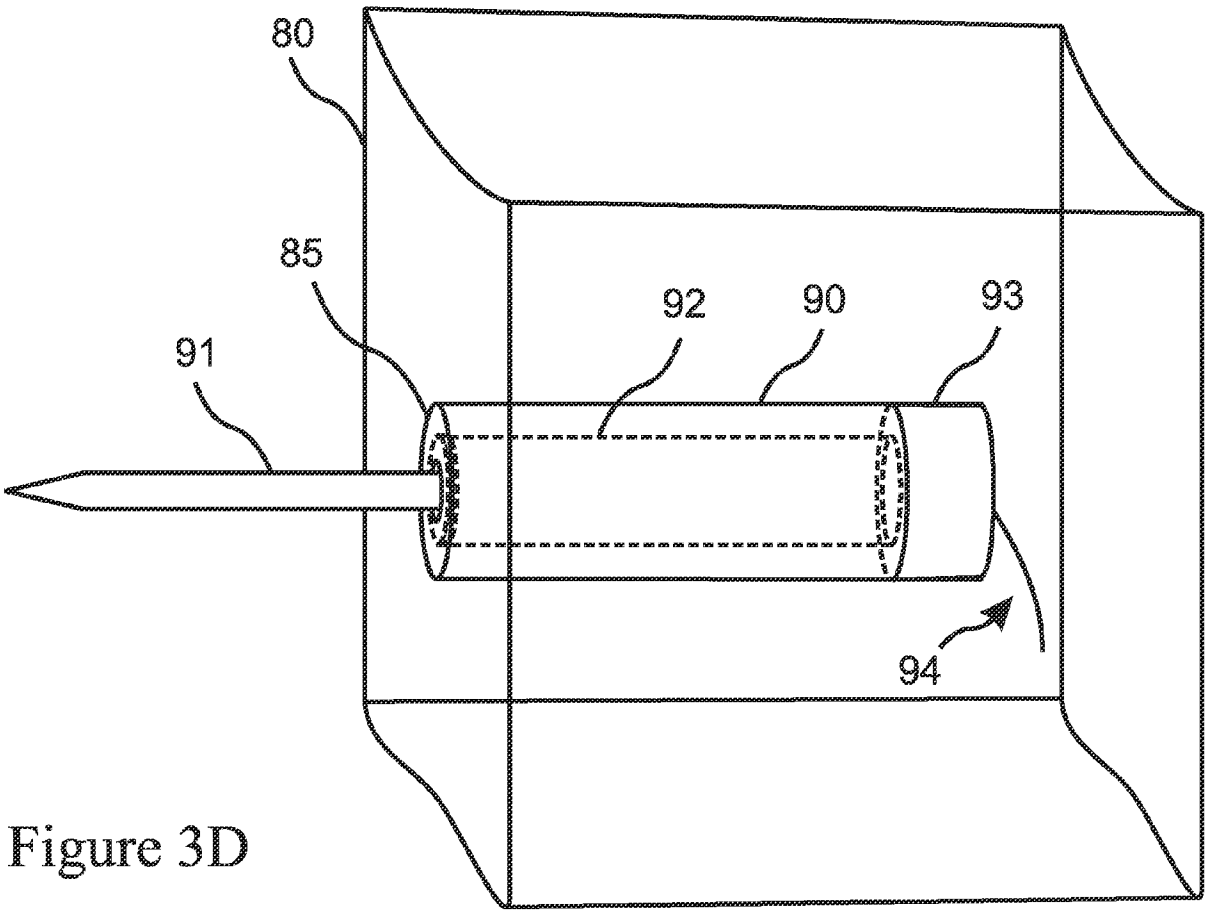
Figure 3E:
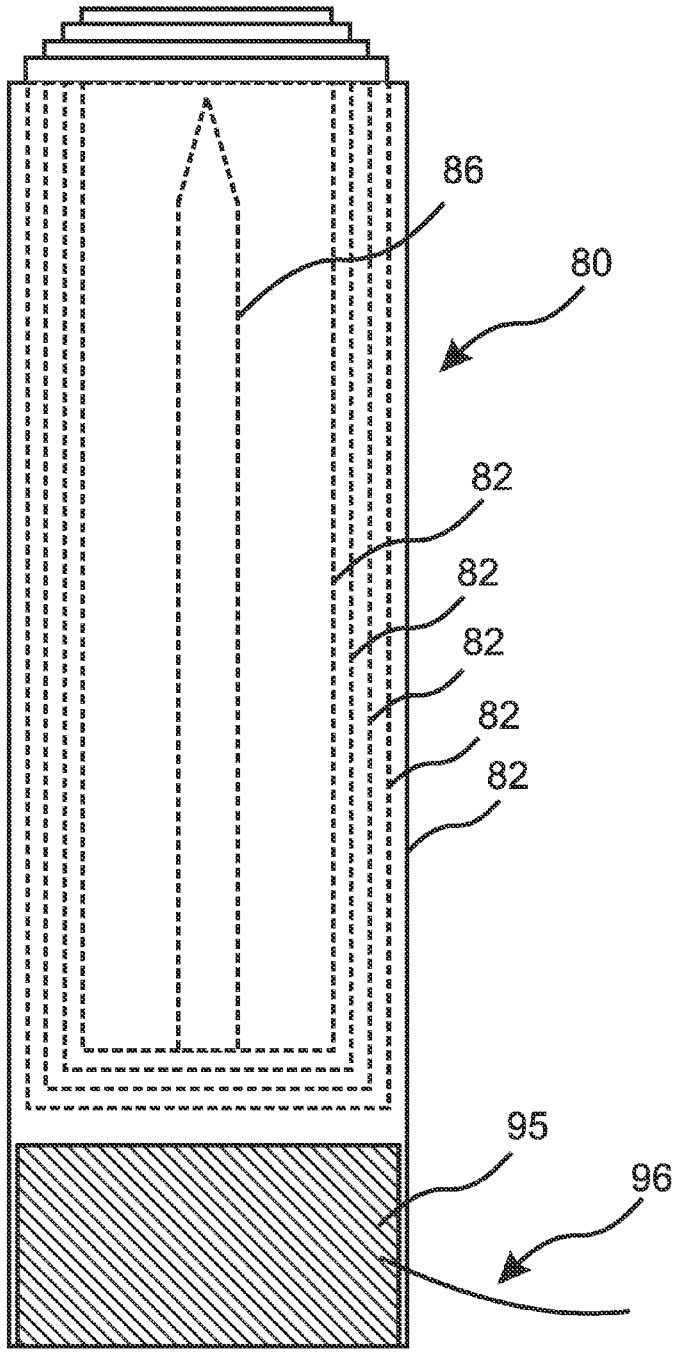

Referring to FIG. 3A and FIG. 3B, telescoping reinforcing edge members 80, in the form of telescoping studs, are provided as a component of system 10 for strengthening at least the vertical edges of the opening. Additional studs may be used to enforce the top and/or the bottom of the opening. These studs or reinforcing edge members may be in the form of pultruded carbon telescoping shafts 82 or rectangular studs 84 comprising multiple sections which may be configured with apertures 83 or 85 for application of manual or explosively applied fasteners into the door jamb.

Telescoping edge members 80 may also be configured for explosive telescopic extension, and may be further configured with piercing end points 86, for further strengthening of the framework created in the opening by the deployed edge members. There may be two, three or four edge members available for this purpose. The first two may be applied to the opposing, vertical jambs.

The front facing inflatable rectangular envelope 20 is configured with door jamb or edge locking channels 30 incorporated into its vertical edges for wrapping around and gripping the vertical door jambs of a door opening or edges of a similar opening in a wall, to which the reinforcing edge members 80 of FIGS. 3A-3B have been applied. The top and/or bottom edges of envelope 20 may be similarly configured with a locking channel 30. As is readily apparent from the cross section view of FIG. 1A and FIG. 1B, the edge gripping lobes 27A-D and channels 30 will tend to grip a thinner wall or edge defining member with a deeper or farther reaching grip than it will a thicker wall or edge defining member, corresponding appropriately with the relative strength of the wall or edge member as its thickness is likely to represent. The flexible nature of the system 10 components enables it to fit a range of opening sizes.

The system incorporates integral means for quickly removing the barrier from the opening, operable from the inside or back side of the barrier, such as by deflating and/or detaching one side of the backside array from the front envelope and by cutting or otherwise fracturing the front envelope or at least one lobe of edge of the envelope from its unprotected back side, so that occupants shielded by the barrier can evacuate the inside space when appropriate. Additional obvious chemical and/or mechanical means are within the scope of the invention.

One embodiment is small enough to fit in a rucksack, although the length of the rolled system may be somewhat awkward due to the 36" length. The barrier system is both slash and stab resistant as a result of the use of ceramic coatings and Vectran fiber. The unit will sustain loss of some compressed gas when compromised by 7.62 caliber rounds and repeated bayonet attacks. However, self-sealing redundant bladders will help prevent system failure.

Some embodiments have at least a two year shelf-life. There may be provisions in the apparatus and methodology of the invention for unpackaging and unrolling or unfolding the inflatable barrier for periodic inspections. These may include partial inflation of the gas envelopes for pressure checks, checking the gas sources for integrity and full charge, and/or checking the telescoping reinforcing edge members for functionality, and repackaging the system.

For some embodiments, the use of vacuum packaging technology and high pressure light weight gas storage may be employed. Alternatively, it is within the scope of the invention to separate the devices and their inflation system into two smaller packages of similar total volume as the standard issue rucksack.

The system weight for one embodiment is under 5 Kg, or 11 lbs. Applicant has within its possession current state-of-the-art protective materials with weights of approximately 9 oz./sq. yd, and having excellent cut resistance. These materials may be arrayed in layers to provide the desired degree of barrier protection. The low mass objective of the invention tightly restricts the use of foam materials as this part of the system has high mass with low unit compressive yield. Additional ballistic protection may be added to the external or protected side of the barrier if the increased weight is acceptable to the user. It is a goal of the invention that the overall effectiveness of the barrier will not be substantially compromised by a hit within the design range of impact type and energy, although a ballistic or other projectile could pierce the barrier, posing a possible threat on the safe side.

The invention includes novel methodologies as well as structures. For example, one embodiment of the inflatable barrier system can be used to completely block a doorway opening using a fast deploying device of the invention, constructed of a flexible multi-layer high-modulus drop thread and air beam configuration. After mounting the inflatable barrier to the opening with the use of telescoping carbon tube stud units, deployment is completed with blown polyurethane foam in the front envelope and inflation of the backside array of bladder units.

Figure 4:
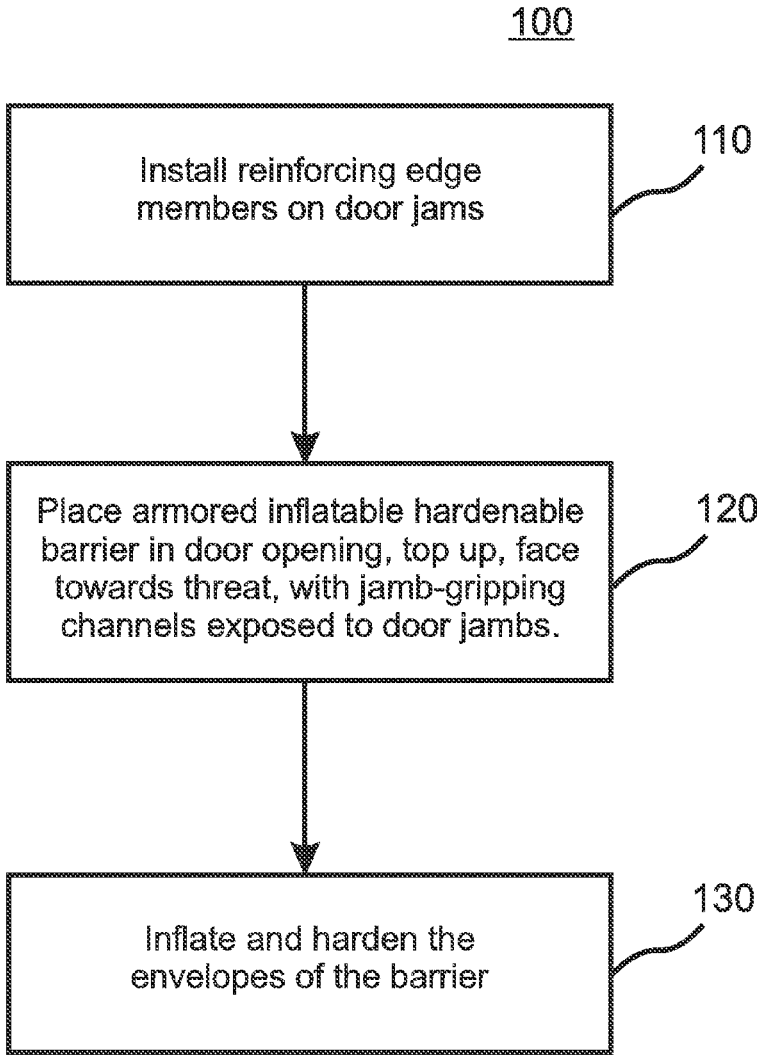
FIG. 4 is a flow chart illustrating the basic methodology for using the inflatable barrier system to deny access to an interior space.

Referring to FIG. 4, one embodiment method 100 for use of the system comprises: step 110, installing two or more reinforcing edge members in the opening; step 120, placing an armor faced, flexible, inflatable, hardenable barrier in the opening with its armored face directed towards the threat, and with its edge gripping channels exposed to the edges of the opening or door jambs; and step 130, inflating and hardening the gas envelopes of the inflatable barrier.

Inflation may be done with a dual redundant gas supply and manifold system connecting to all of the gas envelopes of the inflatable barrier. The reinforcing edge members may be placed selectively on any or all edges of the opening, for the purpose of defining and strengthening the respective edges to help fit and retain the inflatable barrier against frontal assaults. The inflatable barrier may incorporate self-hardening and self-healing characteristics as described herein and as otherwise known in the industry of inflatables, to improve its durability and self-repair capability. The inflatable barrier will have edge gripping channels on at least two opposing sides to provide a grip on the wall of the opening for resisting large area, high pressure assaults against its face. The gas envelopes of the barrier may be configured with known self sealing features. The gas envelopes may have or incorporate excess wall material and volumetric expansion capability to fill a void left by the failure of an adjacent gas envelope. The front face of the barrier may have or be configured with insulating layers and armored layers for improving its resistance to multiple forms of assaults on the barrier.

The inflatable barrier system 10 may be employed according to the FIG. 4 or equivalent methods for closing a doorway to predetermined levels of any or all of push, cut, puncture, flame, chemical, and ballistic attack. A set of three telescoping carbon stud faced tubes, although it might be only two or may be as many as four, may be provided for defining the edge opening for initial mounting of the inflatable barrier.

The first step for deploying the system is to unpack the components. In one embodiment, two telescoping stud tubes are driven into respective opposing sides of the door frame with hand force and locked. Integral explosive loads are then triggered to set the studs on these stud tubes into the door frame. This process requires as little as 20 sec for a trained operator. An additional one or two stud tubes may be set in the same way on the same edges, if needed, or on other edges or at the floor level of the opening so as to create a bottom edge where there may have been none.

The inflatable barrier component of the system is then erected and inflated within the opening such that the door jam or edge member on either side of the doorway, and top jamb and bottom edge member if provided, is gripped between the lobes of the respective ends of the dog bone profile of the fabric envelope. Accurate placement of the inflatable component of the system in the center of the doorway or opening is important for most embodiments.

The next step is the release of the compressed gas and foam materials to fill the dog bone envelope and the various air beams. While the deployment and initial pressurization can be achieved in a very short time, the cure time of the expanding FR Polyurethane foam may take longer. The gas pressure provides the sealing and compressive stiffness in the first few minutes after deployment. The additives to the foams increase compressive strength after appropriate curing time.

In another embodiment, the drop thread weave of envelope 20 creates a shaped void cross section, in the nature of a mold, which permits the introduction of FR (fire resistant) polyurethane expanding foam. The horizontal plane section shape of this structure after inflation and foam fill is the dog bone configuration of FIG. 1B, and is what locks the structure into the doorframe. This drop thread material may be familiar to the reader as the flat bottom used in some inflatable skiffs.

The backside air or gas beams 42 are the secondary elements in the structure configuration. For weight reasons this backside multiple bladder assembly may not be filled with foam and may only be protected with self-sealant. In addition, the inflation system for these bladders may include a surplus of inflation gas and pressure, which may or may not be in the form of a reserve pressure tank, to maintain inflation. The drop thread dog bone envelope and the air beam array provide a defense in depth. The compressive strength of the foam will hold the ISAD barrier system in place after foam cure. The gas pressure in both the air beams and the dog bone provide stiffness before foam cure.

The system is intended to provide a calculated degree of protection from cut, puncture, flame and chemical attack. Since no single fiber provides protection from all these agents, several layers are required to accomplish this in concert. The silicon coated carbon/glass blanket outer layer 26 is designed to deliver two properties. First this layer does not absorb flammable liquids and is not damaged by solvent fires. This combination is suitable for applications up to 2000 F. The ceramic filled silicon coating is suitable for this high temperature requirement. In addition the carbide filling in this coating is very aggressive at damaging the cutting edges of knives. As an attacker works the blade of a bayonet on this coating the cutting edge is destroyed and is less able to damage fiber in the inner layers of the system.

The heavy denier Vectran fabrics are best in class for cut resistance with light weight and minimum packing volume. The Applicant uses this material as a key component in a number of other safety products. Because of poor performance at high strain rate Vectran does not have the best ballistic value. However in this application cut and tear are given a higher priority than ballistic threats. In one embodiment of the invention the weave yarn groups break in snag and tear at in excess of 400 lbs. If these heavy high strength yarn groups are not cut, the attacker will not have enough strength to propagate a tear in this material. In some embodiments a 7.62 caliber munitions may be permitted to pass through the device as the mass budget is not available to a round of this velocity.

Drop thread weave and tube weave bladder systems are based on the Applicant's manufacturing technology in current use or used as part of past project activities, using new base materials. The special weaves are designed and manufactured in Vectran, carbon and glass base fiber in the Applicant's own weaving facility. The coating, sealant application and lamination of the various materials systems is preformed in the fabric finishing area.

Techniques for structural heat seal assembly of high strength inflatables are well known to this applicant and are used to manufacture the multiple bladders and air beams of some embodiments. A hot bar bonder is used to complete this set of tasks. The coatings, foams and other subsidiary materials include Halogenated thermoplastic urethanes, crosslinked halogenated urethane foams, Neoprene foams and ceramic filled silicon coatings.

Other and various embodiments, shapes, and configurations of fabric envelope and second layer protection are within the scope of the invention. For example, there is an inflatable barrier system for closing an opening to frontal attacks that has a front side envelope of rectangular front elevation and dog bone shaped horizontal plane cross section profile with vertically oriented edge gripping channels defined by the lobes of the respective ends of the dog bone shaped profile. The envelope being inflatable with gas and fillable with a hardening foam. There is a source of gas for inflating the envelope and a source of hardening foam for filling and hardening the envelope. It may be one and the same source, such as where the hardening foam is the inflating agent. For example, another embodiment may use a source of halogenated fire resistant urethane foam for filling and hardening the envelope.

The front side envelope may be constructed as a drop thread woven fabric envelope where the length of the drop threads over the area of the envelope defines at least in part the horizontal plane cross section profile of the envelope. The front face of the envelope may be configured with a protective coating system that includes carbon, glass and silicon. Alternately or in addition, it may be configured with a ceramic loaded coating. It may be configured with a glass mat and a base metalized layer. It may be configured with bladders containing CS power.

Other embodiments have an inflatable back side array of tubular gas beams configured with self sealant and combined with the front side envelope, with the backside array being connected to the same or another source of gas for inflating the array. The backside array of tubular gas beams may be a planar array configured as a vertical stack of horizontally disposed gas beams, so that the beam ends are proximate respective vertical edge gripping channels and from those opposing points of support, span the opening from side to side. In other embodiments where top and bottom edge gripping channels are used to grip horizontal top and bottom edges or edge reinforcing members, there may be a planar array of vertically disposed gas beams. The tubular gas beams may be configured with pre-compressed, molded-foam, self-sealing neoprene. The source or sources of gas for inflating the backside array may be a dual redundant source of gas including dual manifold gas delivery system connected at separate points to the backside array of gas beams.

The barrier system may include a plurality of reinforcing edge members configured with engagement means as described elsewhere within or otherwise, for being secured proximate selected edges of the opening. The reinforcing edge members may be telescoping edge members configured with or incorporate explosive means of stored energy for causing telescopic extension such as a compressed gas cylinder, spring mechanism, or a small explosive charge. There may be any of several means of further manual adjustment for obtaining the desired compression and/or attachment of the edge member proximate the edge, such as using a twisting or jacking motion or by the use of auxiliary fasteners.

It should be noted that while the barrier system even when including edge members is intended to be quickly deployable to a state of usefulness, there may times and places where a frontal assault is anticipated well in advance, and a greater amount of time and effort can be directed to placement of reinforcing edge members using additional tools and/or fasteners to assure maximum reinforcement of the edges of the opening while retaining the ingress and egress and/or field of vision until such time as closure of the opening is required.

There are many ways including integral means for releasing the barrier from the opening when required, operable from the back side of the barrier, such as an integral abrasive cord that can be accessed and used from the back side of the deployed barrier to cut off a lobe of the dog bone profile or cut the envelope front to back along a centerline making it easily pushed outward from the opening. Other chemical and mechanical means may be employed as well.

As yet another example of the invention, it may be characterized as an inflatable barrier kit for closing an opening to frontal attacks comprising the reinforcing edge members, inflatable components and inflation systems described herein.

As yet a further embodiment of the invention, there is a method for closing an opening to frontal attacks, that requires: unpacking an inflatable barrier kit having reinforcing edge members and an inflatable barrier configured with edge gripping channels that are actuated for gripping by inflation of the barrier; installing the reinforcing edge members proximate selected edges of the opening; positioning the inflatable barrier within the opening such that said edge gripping channels are exposed to the reinforcing edge members and edges of the opening; and inflating and filling the barrier with a hardening foam.

As will be appreciated by those skilled in the art, there are other embodiments within and equivalent to the scope of the claims that follow.

I claim:

1. An inflatable barrier system for closing an opening to frontal attacks, the opening being bounded on at least two opposing sides by substantially flat bounding edges, the bounding edges providing accessible opposing sides adjacent to the opening, the inflatable barrier system comprising:

a front side envelope of rectangular front elevation, a horizontal plane cross-sectional profile of the front side envelope having an elongated central region terminated at each end by a pair of opposing lobes, each pair of opposing lobes defining a vertically oriented edge gripping channel into which a bounding edge can be inserted, the gripping channel being bounded on opposing sides by the opposing lobes, the envelope being inflatable with gas and fillable with a hardening foam, said inflation causing the lobes of each pair of opposing lobes to press toward each other so as to grip the bounding edge inserted within the channel, said gripping being sufficient to maintain the front side envelope in attachment to the opening during predetermined levels of push, cut, puncture, flame, chemical, and ballistic attack;

a source of gas for inflating the envelope; an inflatable back side array of tubular gas beams configured with self sealant and combined with the front side envelope, the backside array being connected to the source of gas for inflating the array; and a source of hardening foam for filling and hardening the envelope, a front face of the envelope being configured for resistance to the predetermined levels of push, cut, puncture, flame, chemical, and ballistic attack.

2. The inflatable barrier system of claim 1, said envelope comprising a drop thread woven fabric envelope whereby the lengths of the drop threads define at least in part the horizontal plane cross-sectional profile of the envelope.

3. The inflatable barrier system of claim 1, the front face of the envelope being configured with a protective coating system comprising carbon, glass and silicon.

4. The inflatable barrier system of claim 1, the front face of the envelope being configured with a ceramic loaded coating.

5. The inflatable barrier system of claim 1, the front face of the envelope being configured with a glass mat and a base metalized layer.

6. The inflatable barrier system of claim 1, the envelope configured with bladders containing CS powder.

7. The inflatable barrier system of claim 1, the source of gas and the source of hardening foam comprising a source of halogenated fire resistant urethane foam.

8. The inflatable barrier system of claim 1, said backside array of tubular gas beams comprising a vertical stack of horizontally disposed gas beams.

9. The inflatable barrier system of claim 1, the source of gas comprising a dual redundant source of gas including dual manifold gas delivery system connected at separate points to the backside array of gas beams.

10. The inflatable barrier system of claim 1, said tubular gas beams configured with pre-compressed, molded-foam, self-sealing neoprene.

11. The inflatable barrier system of claim 1, further comprising a plurality of reinforcing edge members configured with an engagement mechanism for being secured to proximate selected edges of the opening.

12. The inflatable barrier system of claim 11, said reinforcing edge members comprising telescoping edge members configured with an explosive mechanism for telescopic extension.

13. The inflatable barrier system of claim 1, comprising an integral release mechanism for releasing the barrier from the opening, the integral release mechanism being operable from the back side of the barrier.

14. An inflatable barrier kit for closing an opening to frontal attacks, the opening being bounded on at least two opposing sides by substantially flat bounding edges such as edges of a door frame, the bounding edges providing accessible opposing sides adjacent to the opening, the inflatable barrier system comprising:

a front side envelope of rectangular front elevation, a horizontal plane cross-sectional profile of the front side envelope having an elongated central region terminated at each end by a pair of opposing lobes, each pair of opposing lobes defining a vertically oriented edge gripping channel into which a bounding edge can be inserted, the gripping channel being bounded on opposing sides by the opposing lobes, said envelope comprising a drop thread woven fabric envelope whereby the lengths of the drop threads define at least in part the horizontal plane cross-sectional profile of the envelope, the envelope being inflatable with gas and fillable with a hardening foam, said inflation causing the lobes of each pair of opposing lobes to press toward each other so as to grip the bounding edge inserted within the channel, said gripping being sufficient to maintain the front side envelope in attachment to the opening during predetermined levels of push, cut, puncture, flame, chemical, and ballistic attack a front face of the envelope being configured for resistance to the predetermined levels of push, cut, puncture, flame, chemical, and ballistic attack;

a source of gas and hardening foam for inflating and hardening the envelope;

an inflatable back side array of tubular gas beams attached to the back of the front side envelope and configured with self sealant;

a source of gas for inflating the back side array; and a plurality of reinforcing edge members, the edge members being configured with engagement mechanisms for being secured to proximate selected edges of the opening.

15. The inflatable barrier kit of claim 14, the source of gas and hardening foam comprising a source of halogenated fire resistant urethane foam.

16. The inflatable barrier kit of claim 15, said tubular gas beams being configured with pre-compressed, molded-foam, self-sealing neoprene.

17. The inflatable barrier system of claim 11, wherein the reinforcing edge members include apertures for application of manually or explosively applied fasteners into a door jam or other proximate selected edge of the opening.

18. The inflatable barrier system of claim 14, wherein the reinforcing edge members include apertures for application of manually or explosively applied fasteners into a door jam or other proximate selected edge of the opening.

* * * * *